United States Patent [19]

Castor et al.

[11] Patent Number: 4,932,823

[45] Date of Patent: Jun. 12, 1990

[54] CAN END TAB SENSING APPARATUS

[75] Inventors: Marvin L. Castor, Berthoud; Craig L. Bartels, Westminster; David R. Miller, Golden, all of Colo.

[73] Assignee: Adolph Coors Company, Golden, Colo.

[21] Appl. No.: 219,046

[22] Filed: Jul. 14, 1988

[51] Int. Cl.[5] ..... B21J 1/00; B21D 39/03

[52] U.S. Cl. ..... 413/66; 413/12; 413/14; 413/16; 413/56; 72/4; 72/404; 356/375; 350/96.29; 73/865.8

[58] Field of Search ..... 413/12, 14, 16, 56, 413/66; 72/4, 9, 10, 26, 404, 405; 350/96.29, 96.15; 73/865.8; 356/273, 375

[56] References Cited

U.S. PATENT DOCUMENTS 4,446,710 5/1984 Sallnert et al. ..... 72/10
4,608,843 9/1986 Grims ..... 413/56

OTHER PUBLICATIONS

Variations of the Stamping Process—paper presented by Klaus W. Blumel, Gerd Hartmann and Peter Lubeck at the 15th Biennial Congress International Deep Drawing Research Group—published May 18, 1988—pp. 9–14.

*Primary Examiner*—Frederick R. Schmidt
*Assistant Examiner*—Jack W. Lavinder
*Attorney, Agent, or Firm*—Klaas & Law

[57] ABSTRACT

A press regulating device for detecting can end tab related defects including a plunger assembly for engaging a can end to be tested; a plunger deflection monitoring device; and a data processing device which receives a signal from the plunger deflection monitoring device and a press timing device and which processes these signals to determine whether or not the tested can end is defective and which sends a control signal to the press to terminate press operation upon detection of a defective can end.

8 Claims, 5 Drawing Sheets

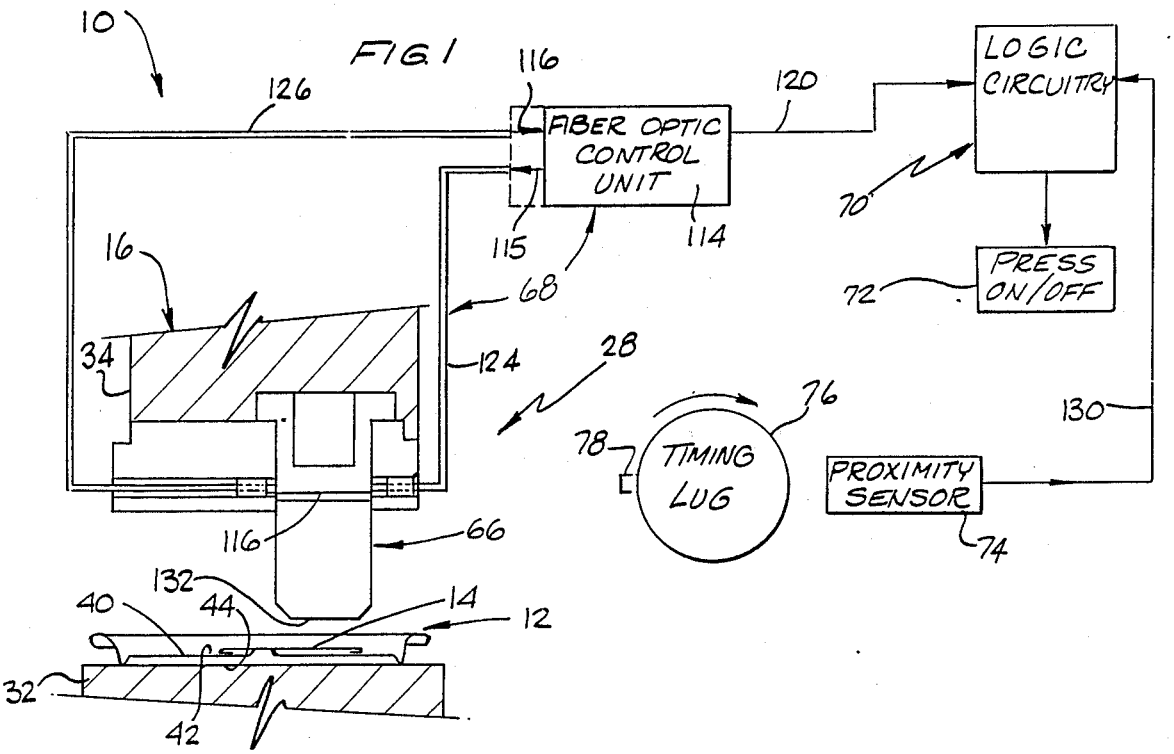
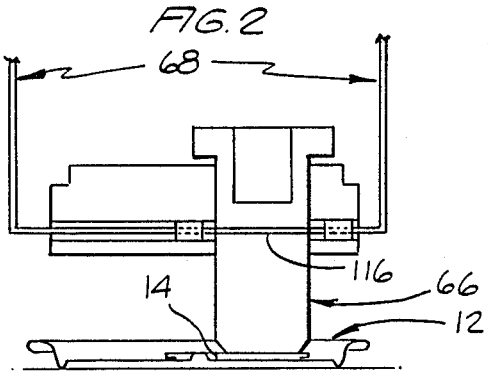
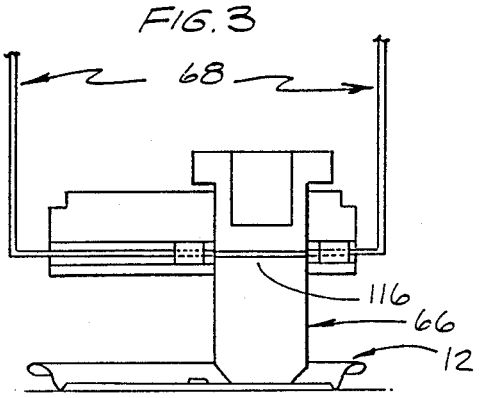
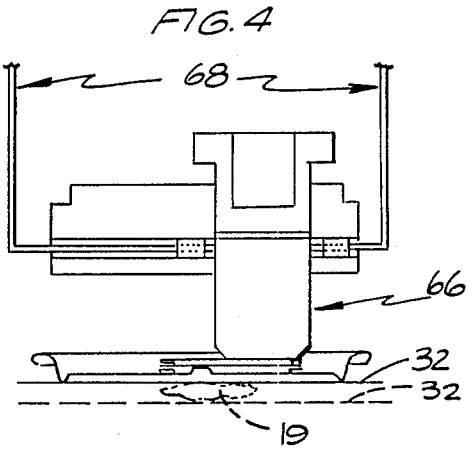
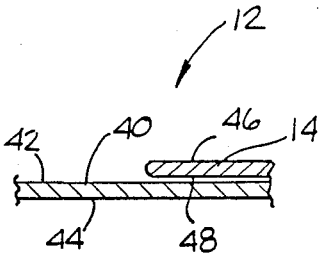
FIG. 5

CAN END TAB SENSING APPARATUS

BACKGROUND OF THE INVENTION

The present invention relates generally to can end production apparatus and, more particularly, to an apparatus for use in association with a can end press for detecting product defects associated with can end tab mounting.

Modern aluminum beverage cans consist of a can body and a sealingly attached can end. The can body comprises a bottom wall and an integrally formed cylindrical sidewall which terminates in a top circular opening. The can end has a generally circular shape and is sealed around the upper opening of the can body after filling of the can body with a beverage. Prior to mounting of a can end on a can body, a can end may undergo a series of processing steps for providing a pull ring-type opening system for the can. Such a pull ring-type opening system is commonly referred to as a "pop top" and includes a pull ring or "tab" which is riveted to the top of the can end. The tab is grasped and pulled away from the can to cause rupture and subsequent opening formation in a scored portion of the can end. To provide such a pull ring-type opening configuration, can end blanks are operated upon by a can end die press. A can end blank, prior to entering a die press, consists of a thin, flat, circular piece of sheet metal having no surface modifications other than a curved, generally upwardly projecting peripheral flange.

The can end passes through a series of different operating stations as it moves through the die press. Different metal forming operations are performed at the different stations. A can end die press is described in U.S. Pat. No. 4,608,843 of Grims for CONVERSION DIE WITH DOUBLE END SENSOR and in U.S. patent application Ser. No. 219,203 of Gold et al. filed on the same date as the present application, for MONITOR AND CONTROL ASSEMBLY FOR USE WITH A CAN END PRESS, both of which are hereby specifically incorporated by reference for all that is disclosed therein. Typical can end die press stations may include a first station for sensing the presence or absence of a can end in the press; a second "bubble-down" station where a downwardly projecting "bubble", which is subsequently formed into a rivet, is formed at the center of the can; a third "bubble-up" station where the downwardly projecting, rivet-forming bubble is inverted to become an upwardly projecting, rivet-forming bubble; a fourth "emboss station" where various printing or other indicia are stamped into the can end; a fifth "score station" where the metal is scored to define the area of the end which is to be ruptured during subsequent opening by a consumer; a sixth "deboss station" at which a downwardly or upwardly extending offset is stamped in the can end to take up metal slack in the can end, and a seventh staking station at which a tab is "staked" to the can end, i.e. attached to the upwardly extending, rivet-forming bubble.

The die press compr-ises a lower fixed die shoe and an upper reciprocating die shoe which moves vertically with respect to the lower fixed die shoe. Each operating station comprises a lower portion mounted on the lower fixed die shoe which receives and holds a single can end thereon during each press stroke. Each operating station also comprises an upper portion mounted on the upper reciprocating die shoe which contains tooling which strikes a can end mounted on the associated lower portion at the bottom of each press stroke. Can ends are progressively moved from station to station between press operating strokes by a transfer assembly. Modern end presses may have a plurality of identical press "lanes," each lane comprising an identical series of operating stations as described above. Typical press operating speeds in a modern can end plant are on the order of 300 strokes per minute.

During press operation tabs are fed into the die press staking station for staking to the can ends. Occasionally, a tab will not feed or will feed improperly, causing a can end to leave the press without a tab. A further problem associated with the absence of a tab on a can end in a misfeed operation is that the misfed tab may be jostled and bounced from station to station within the press, resulting in random scoring of a can end at the station in which the loose tab alights. This random scoring associated with a loose tab end bouncing through the die press may result in "leakers," i.e. ruptured can ends which cause beverage leakage in subsequently formed cans. A misfeed may also occur through presenting two tabs rather than a single tab at the staking station, resulting in the staking of two tabs rather than a single tab to the can end. Such double-staking often causes rupture of the metal of the associated can end, causing a can formed with the double-staked can end to leak.

A number of systems have been designed for use in association with a can end die press for detecting tab-staking malfunctions. One prior art apparatus which is provided at a separate die press station immediately following the tab-staking station consists of a spring-loaded plunger apparatus which extends downwardly from the upper portion of the die press a sufficient distance to make yielding contact with a can end mounted on the lower portion of the die press when the press is at the bottom of an operating stroke. An orifice is provided at the bottom of the plunger device, which is attached in fluid communication with a vacuum source. If a can end with which the plunger makes engagement has a tab properly mounted thereon, the plunger device engages the tab in a manner which provides a space between the plunger end and the flat surface of the can end which thus enables air flow into the orifice at the end of the plunger to remain substantially uninterrupted. However, if no tab is present and the plunger device engages the flat surface of the can end, air flow into the plunger orifice is interrupted and the resulting pressure change within the air flow system acts as a signal to indicate the presence of a can end without a tab. One problem with this system has been that the response time of the system: the time between plunger/-can end engagement and error signal generation, is relatively slow. At the high operating speeds of modern presses, such a slow response time may make the system inoperative, i.e. the duration of any air flow interruption signal is so short as to be difficult to detect at high operating speeds. Another associated problem is that the sensitivity of the pressure system must be adjusted for various press operating speeds. If an operator sets the pressure too high, then a series of false product defect signals are generated. If the pressure is set too low, product defects are not detected at all. A further problem with this system is that it is unable to detect double-staked tabs.

Another prior art system also relies on a spring-loaded plunger provided at a separate operating station immediately downstream of the tab-staking operating station. In this system, a metal detecting device is mounted above the upper terminal metal end of the plunger device and detects the plunger device when it is caused to be deflected upwardly by striking of a tab mounted on the can end. If the plunger device is not deflected upwardly, then the metal proximity sensor is not actuated. Thus, in this system, the absence of a metal detection signal is treated as the detection of a missing tab. One problem with such a system is that metal proximity sensors are quite sensitive and are subject to malfunction when the surrounding electromagnetic field changes, such as may be caused by a press door being left open rather than closed, etc. Thus, the sensitivity of such a metal sensing unit as well as the physical position of the plunger must be carefully adjusted and the device is subject to malfunction when the these adjustments are incorrect. Another problem with such a device is that it is incapable of detecting a double tab staked to a can end, i.e. the double-staking of a can end causes the plunger to be deflected a relatively greater distance upwardly than is usual, but this additional deflection is not distinguished by the metal proximity sensor which merely senses the presence of metal, whether through the deflection associated with a single tab or through the deflection associated with a double tab.

Another device which has been used with some die presses to detect the absence of a tab on a can end includes a pair of electrical sensors, one positioned above the can end and one positioned below the can end, which measure the electrical density through the can end in the region of the tab. A problem with this system is that it cannot be used within the harsh operating environment of the die press apparatus itself, but must rather be used outside of the die press. Such a device may not be used in many existing press designs because of inherent problems associated with transferring can ends out of and then returning can ends to the ordinary production flow from the die press.

Thus, a need exists for a tab sensing device which may be positioned within a die press apparatus and which is capable of accurately determining whether a tab is properly mounted on a can end.

SUMMARY OF THE INVENTION

The present invention may comprise a press regulating apparatus for detecting can end tab related defects for use in association with a can end press of the type having a fixed lower die shoe and a reciprocating upper die shoe which moves toward and away from the fixed die shoe during a press operating stroke, and having a plurality of longitudinally spaced operating stations each having a lower station portion mounted on said fixed die shoe for receiving a can end thereon and an upper station portion mounted on said reciprocating die shoe for carrying tooling for performing a work operation on a can end received on said lower station portion; said can ends being of the type having a thin, flat central body portion having an upper surface and a lower surface which is operated on by said can end press at a tab staking station to normally stake a single, relatively thin, flat tab having an upper surface and a lower surface with said tab lower surface positioned in abutting relationship with said can end upper surface, the can press being subject to malfunctions which produce tab staking defects including can ends having no tab staked thereto and can ends having more than one tab staked thereto, the apparatus comprising: (a) a testing station in said can end press located downstream of said tab staking station including: (i) a lower testing station portion mounted on said lower die shoe and adapted to receive a can end thereon; and (ii) an upper testing station portion mounted on said upper die shoe above said lower testing station portion and reciprocally movable toward and away from said lower testing station portion during a press operating stroke; (b) a plunger means operably mounted on said upper testing station portion for engaging a can end positioned on said lower testing station portion in a region of the can end which normally has a tab staked thereto for being deflected upwardly with respect to a fixed reference within the testing station upper portion in response to engaging said can end: (i) into a first deflection location during engagement with a can end having no tab staked thereto; (ii) into a second deflection location during engagement with a can end having a single tab staked thereto; and (iii) into a third deflection location during engagement with a can end having more than one tab staked thereto or having scrap positioned thereunder; (c) plunger deflection sensing means for sensing the deflection of said plunger means in each of said first, second and third deflection locations and for providing a sensing signal indicative of the deflection location which is sensed; and (d) data processing means for receiving said sensing signal and for terminating operation of said press in response to receiving a sensing signal indicative of one of said first and third deflection positions whereby press operation is stopped at the occurrence of a press staking malfunction which produces a can end without a tab or a can end with more than one tab.

The plunger deflection sensing means of the invention may comprise: (a) light source means positioned at a fixed location in said upper testing station adjacent to said plunger means; (b) light responsive means adapted to provide a signal in response to light received from said light source means, light shieldingly located at a fixed location in said upper testing station portion adjacent said plunger means; (c) small diameter light transmitting means extending radially through said plunger means at an axial and circumferential position thereon which is positioned in alignment with said light source means and said light responsive means when said plunger is positioned in said second deflection location associated with the sensing of a can end with a single tab; and (d) whereby said light responsive means produces: (i) no light detection signal in response to the engagement of said plunger means with a can end having no tab staked thereto; (ii) a single short duration light detection signal in response to the engagement of said plunger means with a can end having a single tab staked thereto; and (iii) two short duration light detection signals in response to the engagement of said plunger means with a can end having more than one tab staked thereto or having scrap positioned thereunder.

The light source and the light responsive means of the invention may both comprise fiber optic strands connected to a conventional fiber optic signal generating unit which generates electrical signals in response to the detection of light from the light source portion of the unit being received by the light responsive portion of the unit.

BRIEF DESCRIPTION OF THE DRAWING

An illustrative and presently preferred embodiment of the invention is shown in the accompanying drawings in which:

FIG. 1 is a schematic view of the major operating components of a can end press regulating apparatus in a retracted position.

FIG. 2 is a schematic view of a portion of a press regulating apparatus in engagement with a can end having a single tab staked thereto.

FIG. 3 is a schematic view of a portion of a press regulating apparatus in engagement with a can end having no tab staked thereto.

FIG. 4 is a schematic view of a portion of a press regulating apparatus in engagement with a can end having two tabs staked thereto.

FIG. 5 is a detail cross sectional elevation view of a portion of a can end having a single tab staked thereto.

DETAILED DESCRIPTION OF THE INVENTION

In General

Figure 2A:
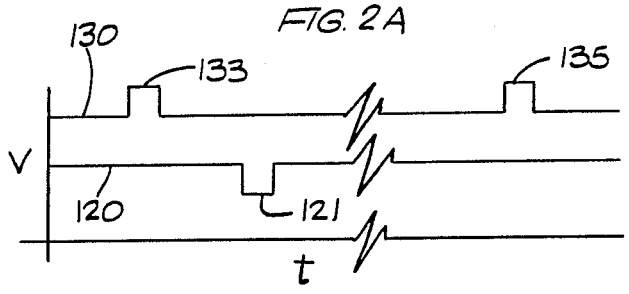
FIG. 2A is a schematic illustration of fiber optic unit and timing unit signals associated with the operation illustrated in FIG. 2 wherein the vertical axis indicates signal voltage and the horizontal axis indicates time.

FIG. 1 schematically illustrates a press regulating apparatus 10 for detecting can end tab related defects for use in association with a can end press 16. The press may be of the type shown in FIG. 6 having a fixed lower die shoe 18 and a reciprocating upper die shoe 20 which moves toward and away from the fixed die shoe 18 during a press operating stroke. The press has a plurality of longitudinally spaced operating stations 21–29 each having a lower station portion 32 mounted on the fixed die shoe 18 for receiving a can end 12 thereon and an upper station portion 34 mounted on the reciprocating die shoe 20 for carrying tooling for performing a work operation on a can end received on the lower station portion.

Figure 6:
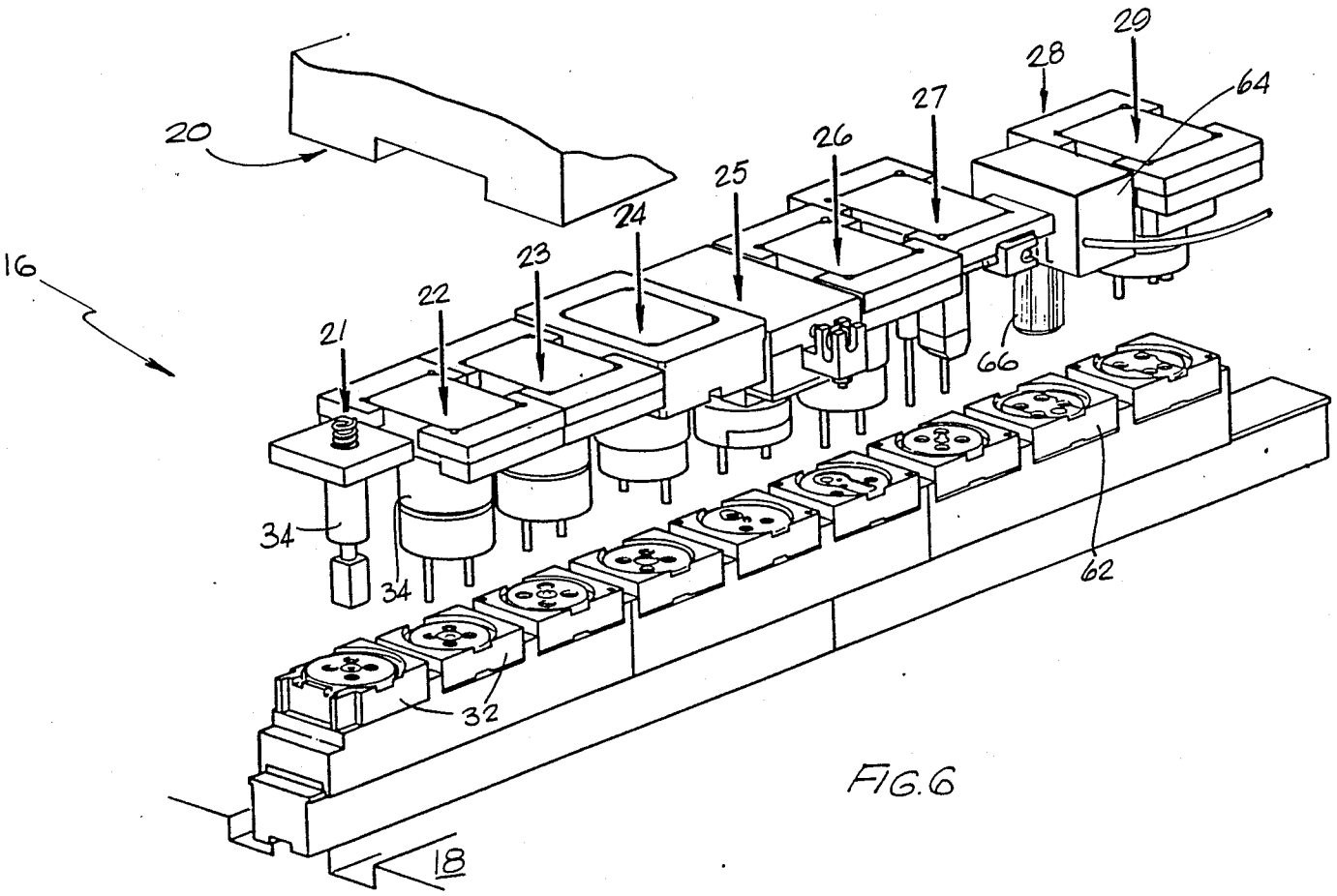
FIG. 6 is an exploded perspective view of operating stations of a can end conversion press.

The can ends 12 are of the type having a thin, flat central body portion 40, FIGS. 1 and 5, having an upper surface 42 and a lower surface 44 which is operated on by the can end press 16 at a tab staking station 27, FIG. 6, to normally stake a single, relatively thin, flat tab 14 having an upper surface 46 and a lower surface 48, FIG. 5, with the tab lower surface 48 positioned in abutting relationship with the can end upper surface 42. A typical tab thickness is 0.065 inches. The can press is subject to malfunctions which produce tab staking defects including can ends having no tab staked thereto, FIG. 3, and can ends having more than one tab 14, 15 staked thereto, FIG. 4.

Figure 7:
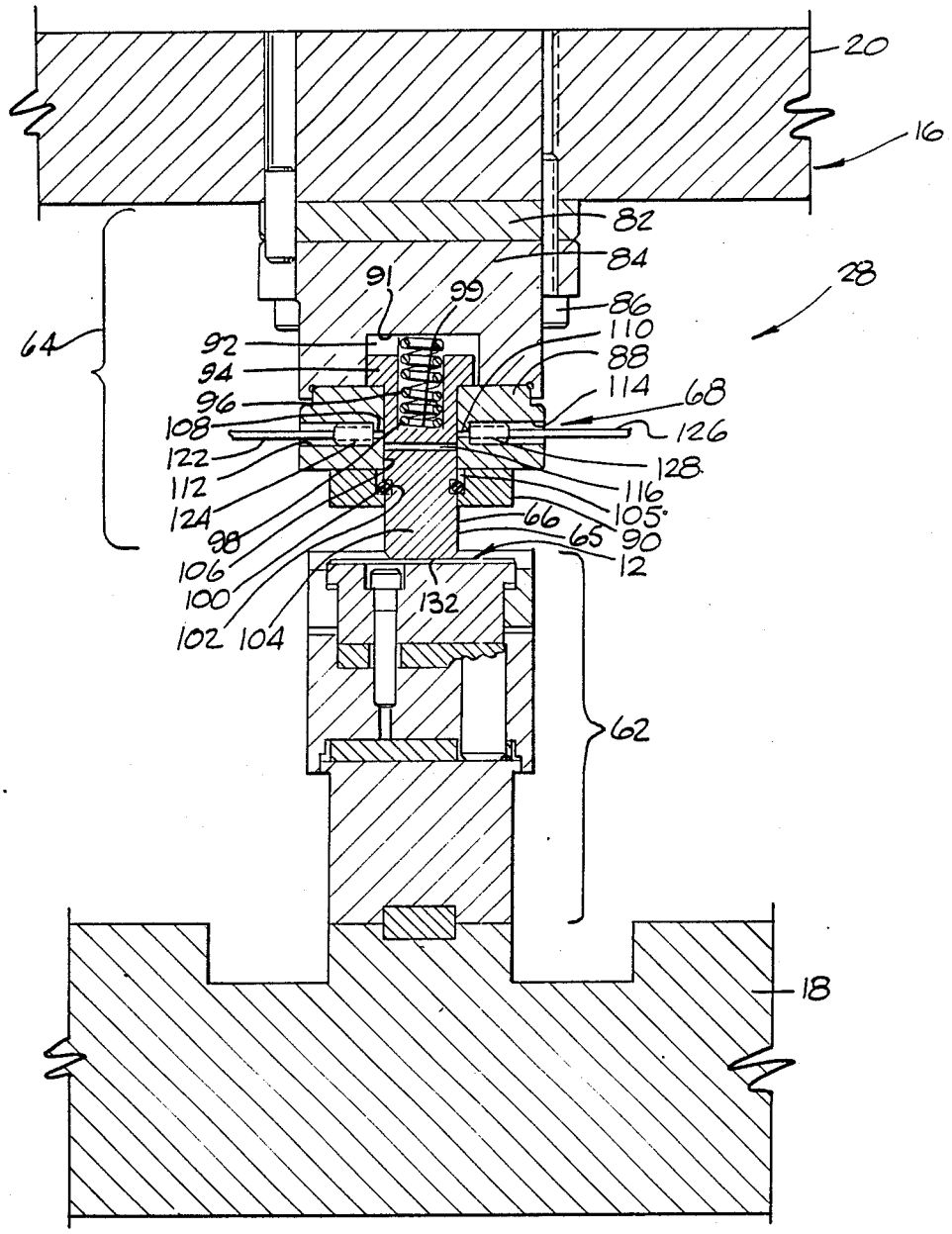
FIG. 7 is a detail cross sectional elevation view of a can end press tab mounting testing station.

The press regulating apparatus 10 includes: a testing station 28, FIGS. 1, 6 and 7, in the can end press 16 located downstream of the tab staking station 27. Testing station 28 includes a lower testing station portion 62 mounted on the lower die shoe 18 and adapted to receive a can end thereon and also includes an upper testing station portion 64 mounted on the upper die shoe 20 above the lower testing station portion 62. The upper station portion is reciprocally movable toward and away from the lower station portion during a press operating stroke. A plunger assembly 66 is operably mounted on the upper testing station portion 64 and is adapted for engaging a can end 12 positioned on the lower testing station portion 62 during a press operating stroke. The plunger assembly engages the can end in a region thereof which normally has a tab staked thereto. The plunger assembly is designed to be deflected upwardly with respect to a fixed reference point within the testing station upper portion 64 in response to engaging a can end. The plunger assembly is deflected into a first deflection location, typically a deflection of less than 0.060 inches, FIG. 3, during engagement with a can end 12 having no tab staked thereto. The plunger assembly is deflected into a second deflection location, typically a deflection of between 0.060 inches and 0.065 inches, FIG. 2, during engagement with a can end having a single tab 14 staked thereto. The plunger assembly is deflected into a third deflection location, typically a deflection of greater than 0.065 inches, FIG. 4, during engagement with a can end having more than one tab 14, 15 staked thereto or during engagement with a can end having scrap material 19 positioned therebelow which elevates the can end above its normal elevation with respect to the lower station portion 32.

A plunger deflection sensing apparatus 68 which may include a fiber optics light responsive unit is provided for sensing the deflection of the plunger assembly 66 in each of the first, second and third deflection locations and for providing a sensing signal indicative of the deflection location which is sensed. A data processing assembly 70 is provided for receiving the sensing signal and for terminating operation of the press by sending a signal to press on/off control unit 72 in response to receiving a sensing signal indicative of either the first or third plunger deflection positions. Thus, press operation is stopped at the occurrence of a press staking malfunction which produces a can end without a tab or a can end with more than one tab.

Having thus described the invention in general, specific features of the invention will now be described in further detail.

Plunger Assembly

As illustrated in FIG. 7, a plunger assembly 66 is reciprocally mounted within a testing station upper portion 64. The station upper portion includes a punch base spacer 82 positioned adjacent upper die shoe 20, a punch base 84 positioned adjacent the spacer 82, a plurality of screws 86 attaching the punch base and spacer to the upper die shoe, a punch center member 88 fixedly attached to a lower portion of the punch base, and a seal cap 90 which is attached to the punch center member 88. The punch base 84 has a centrally positioned bore 92 therein which is adapted to allow reciprocal movement of an upper enlarged portion 94 of plunger member 65 of plunger assembly 66. A coil spring 96 positioned within a central cavity 98 in the plunger member 65 engages a planar, horizontal surface 91 of bore 92 at one end thereof and a planar, horizontal surface 99 of bore 98 at the other end thereof. The spring biases the plunger 66 downwardly. An O-ring 100, which is received in an annular recessed portion 102 in a lower portion 104 of the plunger member, is also received in an annular groove portion 105 of seal cap 90. The O-ring enables light sealed, sliding, upward and downward movement of plunger assembly within the bore 104 provided in seal cap 90. The plunger 55 is also closely slidingly received within a bore 106 in the punch center member 88. The punch center member 88 also comprises coaxial, diametrically oppositely positioned, radially extending, small diameter bores 108, 110 which communicate the central axial bore 106 in the punch center member. Larger diameter, radially extending bores 112, 114 communicate with and are coaxial with small diameter bores 108 and 110, respectively. A radial bore 116 is provided at a central portion of the plunger member 65. Radial plunger bore 116, when at the proper elevation, is coaxially alignable with small diameter bores 108, 110 in the punch central member 88. Bores 108, 110 may each have a diameter of, e.g., 0.040 inches. Bore 116 may have a diameter of 0.062 inches.

Deflection Detection Assembly

An assembly 68 for detecting various plunger deflection states may include a conventional fiber optics unit 114 which has a light emitting portion 115 and a light detecting portion 116, FIG. 1. When light is received by the light detecting portion, a signal indicative thereof is provided to data processing apparatus 70. A first fiber optic strand 122 equipped with a conventional locating head 124 at one end thereof is positioned to transmit light into axial bore 108. Fiber optic strand 124 is operably connected to the light transmitting portion 115 of fiber optic unit 114. A second fiber optic strand 126 having a locating head 128 has one end thereof positioned in bore 114 and is adapted to receive light transmitted into small diameter bore 110. Fiber optic strand 126 is operably connected to the light detecting portion 116 of fiber optic unit 114. The manner in which the plunger assembly is mounted in the upper die portion 66 ordinarily prevents light from being transmitted from bore 108 to bore 110. However, when the plunger is positioned in the relatively deflected position, illustrated in FIG. 3, in which the bore 116 is aligned with bores 108 and 110, light is transmitted through bore 116 from the first fiber optic strand 124 to the second fiber optic strand 126, causing the fiber optic unit to sense light and to transmit an electronic signal 120 indicative of the presence of light to data processing unit 70 so long as bores 108, 110 and 116 remain in alignment. The punch assembly is constructed and arranged such that the amount of plunger deflection necessary to cause alignment of bore 116 with bores 108 and 110 is produced when the upper tool portion 64 is in its lowermost position during a press stroke and when the plunger assembly 66 is in engagement with a can end 12 having a single tab 14 staked thereto. The plunger assembly comprises a flat lower surface 132 which ordinarily makes abutting contact with the upper surface 46 of a tab mounted on a can end during the end portion of a press stroke. The die press remains at its lowermost position for only a fraction of a second and thus the signal produced by engagement of the plunger assembly with a can end having a single tab mounted thereon, as illustrated in FIG. 2A, is a single short duration signal pulse 121, as illustrated in FIG. 2A.

Figure 3A:
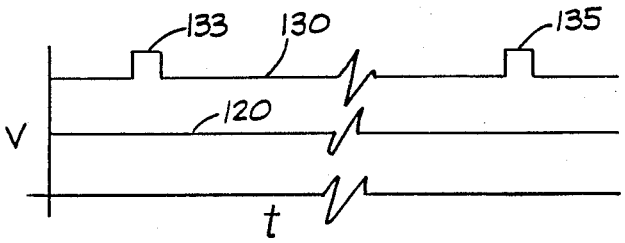
FIG. 3A is a schematic illustration of fiber optic unit and timing unit signals associated with the operation illustrated in FIG. 3 wherein the vertical axis indicates signal voltage and the horizontal axis indicates time.
Figure 4A:
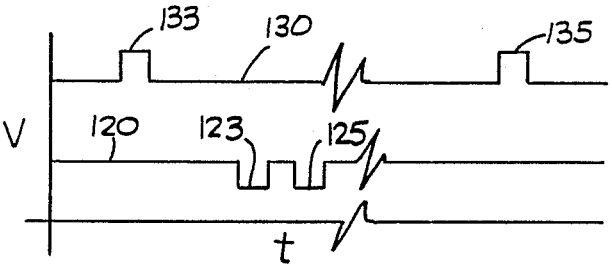
FIG. 4A is a schematic illustration of fiber optic unit and timing unit signals associated with the operation illustrated in FIG. 4 wherein the vertical axis indicates signal voltage and the horizontal axis indicates time.

If, as illustrated in FIG. 3, the plunger assembly 66 contacts a can end 12 having no plunger mounted thereon, then the axial bore 116 in the plunger never comes into alignment with bores 108 and 110 unless and thus no change in the fiber optics signal 120 is produced, as illustrated by the steady value signal of FIG. 3A.

If, as illustrated in FIG. 4, the plunger assembly 66 engages a can end having two or more tabs staked thereto or if (as shown in phantom in FIG. 4) it engages a can end which is substantially elevated above the surface of the lower die portion upon which it is mounted by a piece of scrap 19 or the like, then the plunger assembly will be deflected upwardly sufficiently so as to move axial bore 116 above bores 108 and 110. Thus, in the situation illustrated in FIG. 4, a first short duration signal pulse 123 is generated as axial bore 116 initially passes into and then out of alignment with bores 108 and 110 during its upward movement, and thereafter a second short duration signal pulse 125 is generated as bore 116 moves downwardly, passing into and then out of alignment with bores 108 and 110. Logic circuitry 70 responds to such a double signal pulse 123, 125 from the fiber optic control unit between timing pulses 132, 132 by terminating operation of the press, as described in further detail hereinafter.

Data Processing Means and Timing Means

As illustrated schematically in FIG. 1, a data processing means 70, which may comprise conventional logic circuitry, is provided which receives sensing signal 120 from the fiber optic control unit and which also receives a timing signal 130 from a conventional proximity sensor unit 74. A conventional timing lug 76 which is mechanically linked to the press revolves once during each press reciprocal movement cycle. A raised portion 78 on the timing lug 76 comes into the proximity of metal proximity sensor once during each press stroke cycle and causes the emission of a single timing pulse 132 during each press stroke cycle. The logic circuitry, based upon the signal inputs 120, 130, allows the press to continue running if a can end is sensed to have a single tab or terminates operation of the press, as indicated at 72, if a can end is sensed to have no tab thereon, FIG. 3, or is sensed to have a double tab thereon, FIG. 4, or, alternately, is sensed to have scrap 19 in the sensing die, FIG. 4. The use of timing lugs 76 and metal proximity sensors 74 are well-known in the art.

Figure 8:
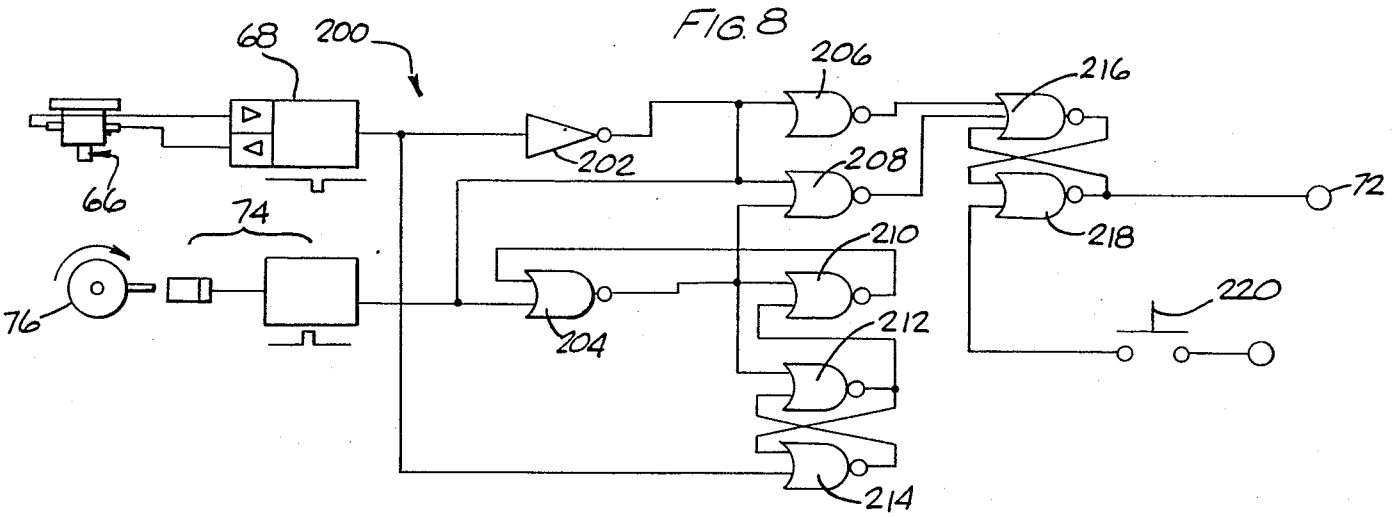
FIG. 8 is a circuit diagram of electronics used for detecting a can end having no tab mounted thereon.
Figure 9:
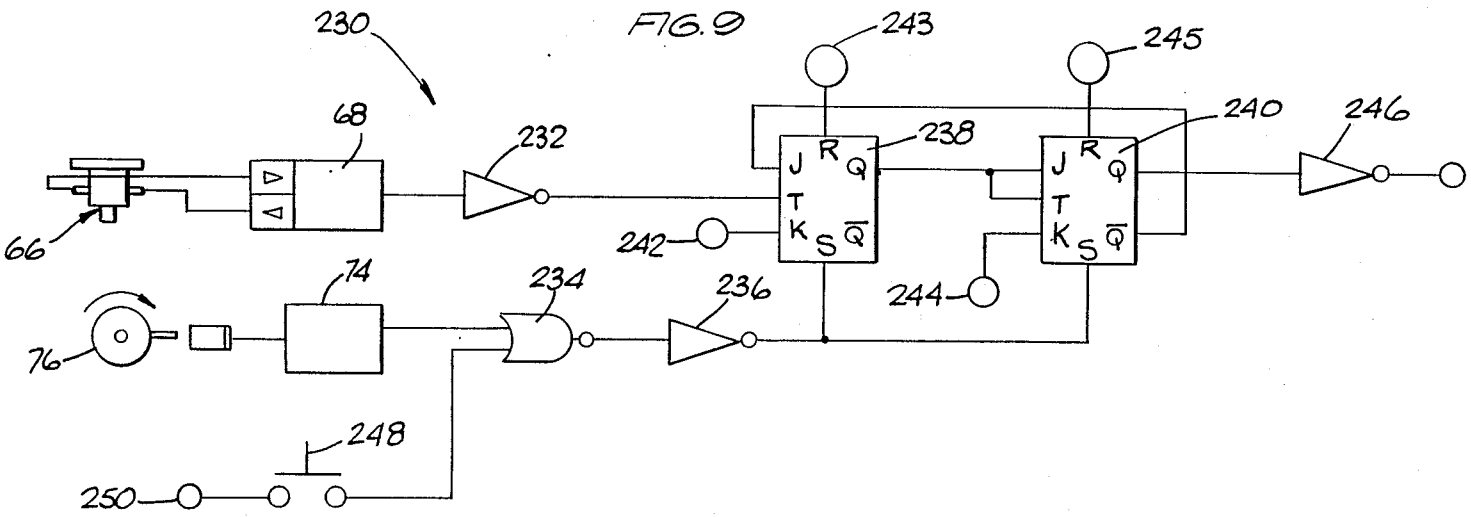
FIG. 9 is a circuit diagram of electronics used for detecting a can end having a plurality of tabs mounted thereon or having scrap under the can end.

The logic circuitry 70 may comprise a first logic circuit 200, such as illustrated in FIG. 8, for sensing the presence of a can end having no tab thereon, and may comprise a second logic circuit 230, such as illustrated in FIG. 9, for detecting a can end having more than one tab mounted thereon or having scrap in the underlying portion of the die.

As illustrated in FIG. 8, the fiber optics unit 68 may be of the type which produces a high signal value in the absence of light detection and which produces a low signal value in response to the detection of light (corresponding to the period of alignment of the plunger bore 116 with bores 108 and 110, typically a period of about 10 milliseconds). The fiber optics unit may be a conventional, off-the-shelf unit. The proximity sensor 74 may be of the type producing an electronic signal which is ordinarily of a low value but which produces a pulse having a high value during the period, e.g. 10 milliseconds, during each press stroke cycle that the timing lug raised portion 7 is in the immediate proximity of the sensor 74. The proximity sensor 74 may be of a conventional type that are well known in the art. As further illustrated by FIG. 8, the output of the fiber optics unit 68 and proximity sensor 74 are connected to a first circuit 200 comprising a pulse inverter 202, a first NAND gate 204, a second NAND gate 206, a third NAND gate 208, a fourth NAND gate 210, a fifth NAND gate 212, a sixth NAND gate 214, a seventh NAND gate 216, and an eighth NAND gate 218. As illustrated, the output of the fiber optics unit is input to the signal inverter 202 and to the sixth NAND gate 214. The output from the proximity sensor 74 is input to the first NAND gate 204, the second NAND gate 206, and the third NAND gate 208. The first NAND gate 204 provides a signal output which is input to the third NAND gate 208, fourth NAND gate 210, and fifth NAND gate 212. The second NAND gate 206 provides a signal output to the seventh NAND gate 216. The third NAND gate 208 provides a signal output to the seventh NAND gate 216. The fourth NAND gate 210 provides a signal output to the first NAND gate 204. The fifth NAND gate 212 provides a signal output to the fourth NAND gate 210 and to the sixth NAND gate 214. The sixth NAND gate 214 provides a signal output to the fifth NAND gate 212. The seventh NAND gate 216 provides a signal output to the eighth NAND gate 218. The eighth NAND gate provides a signal output to allow or terminate operation of the press. The eighth NAND gate has a signal input from a manually-operated reset button 220 which is depressed by a press operator to restart the press subsequent to a circuit 200 press shutdown. The pulse inverter 202 and the various NAND gates 204, 206, 208, 210, 212, 214, 216, 218 may be of any conventional commercially-available type. As is well-known by those having skill in the art, a signal inverter inverts a signal received thereby such that a signal high is converted to a signal low and a signal low is converted to signal high. As is also well-known by those having skill in the art, a NAND gate outputs a low signal only in response to receiving all high signals at its signal inputs and otherwise outputs a high signal. It will also be appreciated by those having skill in the art that circuit 200 will produce a high signal output to on/off unit 72 which allows press operation to continue so long as the fiber optics unit 68 puts out at least one low value signal pulse, e.g. 121, FIG. 2A, between each pair of pulses 133, 135 produced by the proximity sensor unit 74 and when no such fiber optic signal pulse is produced between timing pulses, e.g. 133, 135, FIG. 3A, circuit 200 provides a low signal value to on/off unit 72 which responds by terminating press operation. After the termination of press operation, the generation of a high signal by use of the press reset button 220 by the press operator resets the memory unit 216, 18, allowing the press to continue operation until the signal condition associated with the detection of a can end with no tab is again present, again resulting in press operation termination, etc.

As illustrated by FIG. 9, the logic circuitry also comprises a second circuit 230 receiving the output from the fiber optics unit 66 and proximity sensor unit 74. The second circuit 230 comprises a first signal inverter 232; a first NAND gate 234; a second signal inverter 236; a first JK Flip Flop 238; a second JK Flip Flop 240; a first, second, third, and fourth positive voltage source 242 which may be a 12-volt voltage source; a third signal inverter 246; and a reset push button 248 connected to a negative 12-volt voltage source 250.

The fiber optics unit output 68 is transmitted to the first signal inverter 232, the proximity sensor output is sent to the first NAND gate 234, and the push button 248 output in also sent to the first NAND gate 234. The first NAND gate output is sent to the second signal inverter 236, the first signal inverter 232 output is sent to the T-terminal of the first JK Flip Flop 238, the signal output from the second signal inverter 236 is sent to the S-terminal of the first JK Flip Flop 238 and the S-terminal of the second JK Flip Flop 240. The first JK Flip Flop 238 is connected at its K-terminal to positive voltage source 242 and is connected at its R-terminal to positive voltage source 243. First JK Flip Flop 238 J-terminal is connected to the Q-bar-terminal of the second JK Flip Flop 240. The Q-terminal of the first JK Flip Flop is connected to the Jand T-terminals of the second JK Flip Flop. The second JK Flip Flop is connected at its K-terminal to positive voltage source 244 and at its R-terminal to positive voltage source 245. The second JK Flip Flop is connected at its Q-terminal to the input of the third pulse inverter 246. The circuit 230 ordinarily outputs a high signal to on/off unit 72 which responds to a high signal by allowing continued operation of the press. However, whenever two or more pulses, e.g. 123, 125, from fiber optic unit 68 are emitted between any two sequential timing pulses, e.g. 132, 132, FIG. 4A, a low signal is sent by circuit 230 to unit 72 which responds by terminating operation of the press. Press operation is reset by use of reset button 248.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A press regulating apparatus for detecting can end tab related defects for use in association with a can end press of the type having a fixed lower die shoe and a reciprocating upper die shoe which moves toward and away from the fixed die shoe during a press operating stroke, and having a plurality of longitudinally spaced operating stations each having a lower station portion mounted on said fixed die shoe for receiving a can end thereon and an upper station portion mounted on said reciprocating die shoe for carrying tooling for performing a work operation on a can end received on said lower station portion; said can ends being of the type having a thin, flat central body portion having an upper surface and a lower surface which is operated on by said can end press at a tab staking station to normally stake a single, relatively thin, flat tab having an upper surface and a lower surface with said tab lower surface positioned in abutting relationship with said can end upper surface, the can press being subject to malfunctions which produce tab staking defects including can ends having no tab staked thereto and can ends having more than one tab staked thereto, the apparatus comprising:

(a) a testing station in said can end press located downstream of said tab staking station including:

(i) a lower testing station portion mounted on said lower die shoe and adapted to receive a can end thereon; and (ii) an upper testing station portion mounted on said upper die shoe above said lower testing station portion and reciprocally movable toward and away from said lower testing station portion during a press operating stroke;

(b) a plunger means operably mounted on said upper testing station portion for engaging a can end positioned on said lower testing station portion in a region of the can end which normally has a tab staked thereto for being deflected upwardly with respect to a fixed reference within the testing station upper portion in response to engaging said can end:

(i) into a first deflection location during engagement with a can end having no tab staked thereto;

(ii) into a second deflection location during engagement with a can end having a single tab staked thereto; and (iii) into a third deflection location during engagement with a can end having more than one tab staked thereto or having scrap positioned thereunder;

(c) plunger deflection sensing means for sensing the deflection of said plunger means in each of said first, second and third deflection locations and for providing a sensing signal indicative of the deflection location which is sensed; and (d) data processing means for receiving said sensing signal and for terminating operation of said press in response to receiving a sensing signal indicative of one of said first and third deflection positions whereby press operation is stopped at the occurrence of a press staking malfunction which produces a can end without a tab or a can end with more than one tab.

2. The invention of claim 1, said plunger deflection sensing means comprising:

(a) light source means positioned at a fixed location in said upper testing station adjacent to said plunger means;

(b) light responsive means adapted to provide a signal in response to light received from said light source means, light shieldingly located at a fixed location in said upper testing station portion adjacent said plunger means;

(c) small diameter light transmitting means extending radially through said plunger means at an axial and circumferential position thereon which is positioned in alignment with said light source means and said light responsive means when said plunger is positioned in said second deflection location associated with the sensing of a can end with a single tab; and (d) whereby said light responsive means produces:

(i) no light detection signal in response to the engagement of said plunger means with a can end having no tab staked thereto;

(ii) a single short duration light detection signal in response to the engagement of said plunger means with a can end having a single tab staked thereto; and (iii) two short duration light detection signals in response to the engagement of said plunger means with a can end having more than one tab staked thereto or having scrap positioned thereunder.

3. The invention of claim 2 wherein said light source means comprises a first fiber optic strand operably connected to an electrical light source and wherein said light responsive means comprises a fiber optic strand operably connected to a photoelectric light detector.

4. The invention of claim 1 further comprising timing means for generating a timing signal indicative of the occurrence of a period of time during which said plunger is in engagement with a can end and for transmitting said timing signal to said data processing means;

said data processing means processing said plunger deflection sensing signal in response to said timing signal.

5. A quality control device for monitoring the thickness of a plurality of unit products normally having a thickness lying within a predetermined thickness range having a maximum value and a minimum value for detecting nonconforming unit products having a thickness greater than said maximum value or less than said minimum value of said predetermined thickness range comprising:

(a) unit product receiving means for receiving each unit product to be monitored in a preset location and in a preset product orientation thereon;

(b) reciprocal holding means for holding a plunger means therein and for moving said plunger toward and away from said unit product receiving means, said reciprocal plunger means being reciprocally movable between a first position relatively remote from said receiving means and a second position relatively closer to said receiving means;

(c) plunger means mounted within said reciprocal holding means and being biasingly linearly movable therewithin in a direction parallel to the direction of reciprocal movement of said reciprocal holding means, said plunger means being biased in a direction towards said product receiving means; said plunger means being movable into and out of engagement with a unit product received on said unit product receiving means through reciprocal movement of said plunger holding means between said first and second positions thereof; said plunger means having:

(i) a first relatively deflected state within said holding means associated with the engagement of a unit product having a thickness less than said minimum value of said predetermined thickness range;

(ii) a second relatively deflected state associated with a unit product having a thickness within said predetermined thickness range; and (iii) a third relatively deflected state associated with a unit product having a thickness greater than said maximum value of said predetermined thickness range;

(d) plunger deflection detection means for detecting each of said first, second, and third plunger deflection states and for providing a signal indicative thereof.

6. The invention of claim 5, said plunger deflection sensing means comprising:

(a) light source means positioned at a fixed location in said plunger holding means adjacent to said plunger means;

(b) light responsive means adapted to provide a signal in response to light received from said light source means, light shieldingly located at a fixed location in said plunger holding means adjacent said plunger means;

(c) small diameter light transmitting means extending radially through said plunger means at an axial and circumferential position thereon which is positioned in alignment with said light source means and said light responsive means when said plunger is positioned in said second deflection location; and (d) whereby said light responsive means produces:
  (i) no light detection signal in response to the engagement of said plunger means with a unit product having a thickness less than said minimum value;
  (ii) a single short duration light detection signal in response to the engagement of said plunger means with a unit product having a thickness within said predetermined thickness range; and
  (iii) two short duration light detection signals in response to the engagement of said plunger means with a unit product having a thickness greater than said maximum value.

7. The invention of claim 6 wherein said light source means comprises a first fiber optic strand operably connected to an electrical light source and wherein said light responsive means comprises a fiber optic strand operably connected to a photoelectric light detector.

8. A method of testing unit products for detecting unit products of nonconforming thickness in a group of unit products which normally have a thickness lying within a predetermined thickness range defined by a maximum thickness value and a minimum thickness value comprising:

(a) placing each unit product to be tested at a preset orientation on a fixed receiving surface;
(b) moving a reciprocating assembly which is positioned at a preset spacial orientation relative the receiving surface and which has a plunger assembly mounted therein toward and then away from the unit product mounted on the fixed receiving surface during an operating stroke having a predetermined length;
(c) deflectably engaging an outer surface portion of the unit product with the plunger assembly;
(d) monitoring the deflection of the plunger assembly for the occurrence of:
  (i) a first, relatively small deflection amount lying below a first preset deflection threshold value;
  (ii) a second, intermediate deflection amount lying above said first preset deflection threshold value and lying below a second preset deflection threshold value greater than said first value;
  (iii) a third, relatively large deflection amount lying above said second preset deflection threshold value;
(e) identifying each unit product producing either said first or third plunger deflection amount.

* * * * *